United States Patent [19]

Livingston et al.

[11] 4,083,085

[45] Apr. 11, 1978

[54] APPARATUS FOR BLENDING AND PARALLELING TEXTILE FIBERS

[75] Inventors: Emmett S. Livingston, Talbottom, Ga.; Otis B. Alston, Wetumpka, Ala.

[73] Assignee: Dixie Yarns, Inc., Chattanooga, Tenn.

[21] Appl. No.: 686,312

[22] Filed: May 14, 1976

[51] Int. Cl.[2] ..... D01G 15/40

[52] U.S. Cl. ..... 19/105; 19/106 R; 19/145.7; 19/114

[58] Field of Search ..... 19/105, 106, 99, 104, 19/110, 145.7, 128, 200, 115 R, 114

[56] References Cited

U.S. PATENT DOCUMENTS

| | | | |
|---|---|---|---|
| 329,356 | 10/1885 | Bradshaw | 19/108 |
| 3,226,774 | 1/1966 | Reiterer | 19/105 X |
| 3,391,429 | 7/1968 | Watanabe | 19/114 |
| 3,395,425 | 8/1968 | Vinogradov et al. | 19/105 |
| 3,604,062 | 9/1971 | Hollingsworth | 19/113 |

FOREIGN PATENT DOCUMENTS

| | | | |
|---|---|---|---|
| 7,733 of | 1838 | United Kingdom | 19/105 |
| 1,727 of | 1866 | United Kingdom | 19/105 |
| 8,080 of | 1890 | United Kingdom | 19/105 |
| 1,104,682 | 2/1968 | United Kingdom | 19/99 |
| 702,713 | 1/1954 | United Kingdom | 19/105 |

*Primary Examiner*—Dorsey Newton
*Attorney, Agent, or Firm*—Hugh P. Carter

[57] ABSTRACT

Apparatus for blending, paralleling and cleaning fibers such as cotton and synthetics. The apparatus comprises a work roll having its surface covered with metallic wire and an arcuate, metallic wire section cooperating with a portion of the periphery of the work roll. The fiber is fed between the roll and arcuate surface, accomplishing the improved results noted in the accompanying specification.

1 Claim, 2 Drawing Figures

FIG 1
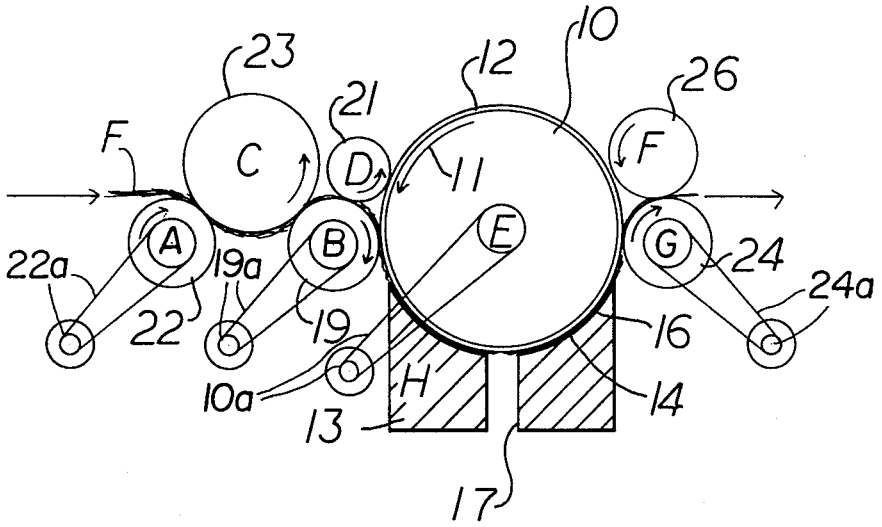
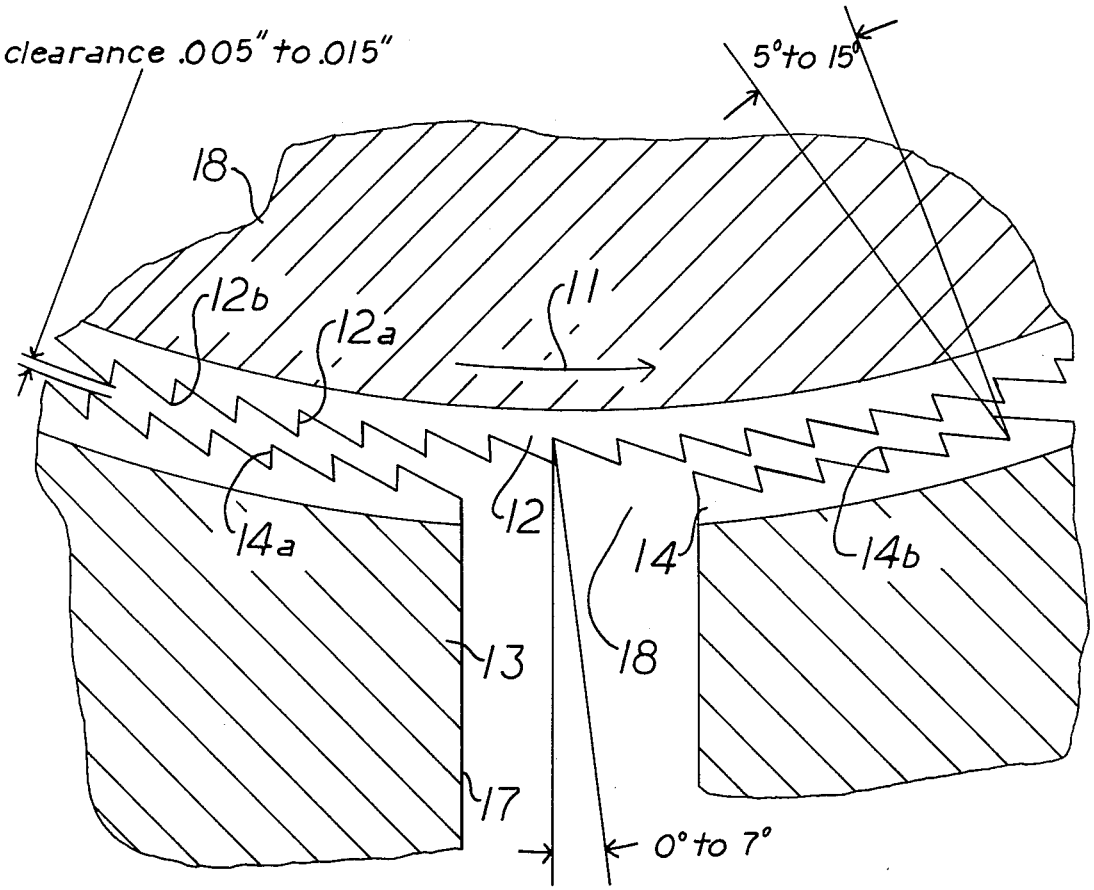
FIG 2

APPARATUS FOR BLENDING AND PARALLELING TEXTILE FIBERS

The invention relates to apparatus for treating textile fibers, both man-made and synthetic, and has for one of its objects the provision of a simple, efficient mechanism which will be fully effective both to blend and parallel fibers passed through the apparatus, in a more efficient manner than has been heretofore done on drafting frames employing the conventional roll draft systems.

A more specific object of our invention is to provide apparatus of the character designated in which the parallelization of the fibers is greatly enhanced, in which blending is more efficiently carried out, and in which incidental cleaning of the fibers is greatly enhanced, all as compared to the present, conventional drafting systems.

Another object of our invention is to provide apparatus of the character designated which will be effective to treat fibers, for instance, silver, which silver contains a certain percentage of short fibers, and to carry out this operation in such fashion that only an inconsequential quantity of the short fibers will be lost.

A more specific object is to provide apparatus for paralleling, blending and cleaning fibers which incorporates a work roll, the roll being covered with metallic wire, in combination with an arcuate section of metallic wire, the points of the respective wires being mounted to run in close, fiber paralleling and blending positions and preferably, the teeth of both of said sets of wires being oppositely raked as will hereinafter appear.

A further and more general object is to provide apparatus which may readily take the place of the present day drafting systems, without material change in any preceding or following apparatus or process in the textile mill, whereby our invention may simply be used in lieu of the present drafting systems.

Apparatus illustrating features of our invention is shown diagrammatically in the accompanying drawing forming a part of this application in which:

FIG. 1 is a vertical, diagrammatic sectional view through our improved apparatus; and FIG. 2 is an enlarged, diagrammatic view illustrating the preferred shape of the teeth, both on the work roll and the arcuate member, together with the preferred clearances between the points of the same.

Referring now to the drawings for a better understanding of our invention we show in FIG. 1 what we will hereinafter call a "work roll" 10. The work roll may be a solid roll approximately 3 5/16ths inch in diameter, made of steel, and mounted in suitable bearings as is customary in the art so that it may be driven in the direction of the arrow 11 by means of a motor, pulleys and belt 10$^a$. The surface of the roll 10 is covered with metallic wire 12 of the general kind ordinarily used in the textile industry, although, as will hereafter appear, we prefer to use wire which has a greater number of teeth per inch namely, approximately 400 teeth per square inch. Suffice it here to say that the entire surface of the roll 10, which may some eight inches in length is covered with such wire 12.

Mounted beneath the roll 10 is a block 13. The block 13 may have an arcuate surface 14 which is covered with metallic wire 16 generally of the kind mentioned above, namely, so as to have more than 400 teeth per square inch on its surface. For reasons hereinafter to appear, block 13 has a vertical slot substantially throughout its length as indicated at 17 and the wire 14 is cut away as at 18, thus to provide a slot in communication with the slot 17.

As shown in FIG. 2 teeth 12 of the wire covering roll 10 are raked forward as shown at 12$^a$, namely, with the points 12$^b$ preceding the bases thereof, when considering the direction of rotation of the roll 10 as indicated by said arrow 11.

In somewhat similar manner the teeth 14 of the arcuate section are raked opposite to the rake of teeth 12, whereby the working edges 14$^a$ thereof are raked rearwardly, with regard to the direction of rotation of the roll 10. Preferably, the degree of rake on the teeth 14 is on the order of five to fifteen degrees as illustrated in FIG. 2.

It will also be noted that the points 12$^b$ and the points 14$^b$ of the teeth are mounted to rotate closely together, preferably, with a clearance between the points of 0.005 inch to 0.015 inch.

Referring again to FIG. 1 we show a set of infeed rolls comprising a lower, metallic, fluted roll 19 and an upper, rubber covered roll 21. These rolls run with their surfaces in contact with each other and as usual in the art are mounted in bearings and are driven in the direction of the respective arrows placed thereon. These rolls receive the fiber F between them and present the same to the surface of the roll 10 ahead of, namely, upstream of the arcuate section 14.

A pair of assist rolls made up of a lower, metallic, fluted roll 22 and an upper rubber covered roll 23 may be provided to aid in the presentation of the fibers F to the rolls 19 and 21.

Downstream of the arcuate section we provide outfeed rolls comprising a lower, metallic fluted roll 24 and either a metallic fluted roll or a rubber covered roll 26.

As will be appreciated, the rolls 19, 22 and 24 are driven. At 19$^a$, 22$^a$, and 24$^a$ we show motors, pulleys and belts for the respective rolls 19, 22 and 24. The rolls 19 and 22 drive the rolls 21 and 23 which receive the fiber F between them. Roll 24 drives the roll 26, to discharge the fiber in the direction of the arrows as indicated.

It will be noted particularly that rolls 19–21 and 24–26 are of considerably less diameter than the roll 10. The reason for this is to make the nips between the rolls 19–21 and 24–26 as short as possible from the working surface of the work roll 10, thereby to obtain and maintain greater control over the fibers passing through the system, especially short fibers.

Concerning speeds, if it be assumed that the roll 10 is turning at a surface speed to deliver 1,000 linear feet per minute of the finished fiber, then, the rolls 19 and 21 would be turning at whatever draft differential is desired. By way of example, in actual practice we have drafted from forty grain to eighty grain sliver at a draft of form five to twelve. Of course, it will be understood that the rolls 24 and 26 are driven at a slighter greater speed than the surface speed of roll 10, thus to doff the roll 10. The assist rolls 22 and 23 may or may not be required, depending upon the length of fiber being handled, the bulk of fiber being handled, and to some degree, the kind of fiber being handled.

With the foregoing in mind it is now possible more fully to explain our invention together with the various advantages thereof. As is known in this art, in conventional drafting of, for instance, cotton sliver, a large percentage of the short and very short fibers have a tendency to bunch up, to an extent that the overall quality of the finished sliver is adversely affected, particularly with respect to unevenness of parallelization. In other words, with conventional drafting systems, as heretofore practiced the short fibers are, by and large not paralleled; instead, they simply go with the stream made up, by and large, of the longer fibers. Stated still again and in a different way, and more to the point, experience indicates that conventional drafting frames cannot, due to the inherent nature of the same, parallel the shortest fibers making up a component of the usual cotton sliver fed to such frames. By way of example, if the drafting distance on a conventional frame is set, say, at 1¼ inches, and cotton sliver is fed to the same, there will be many fibers in such sliver shorter than said 1¼ inches. In such instance the shorter fibers simply are not paralleled because in conventional systems they are too short to bridge the gap between the nips of the rolls.

By contrast to the foregoing, in our improved apparatus we parallel the long, short, and intermediate length fibers, continuously, while they are between the working surface of the work roll 10 and the arcuate section 14. In this zone the parallelization of the fibers is taking place because they are being acted upon by a great multiplicity of relatively fine, close running teeth, to an extent that a fiber of any appreciable length in fact is paralleled with the remaining fibers of the group which it accompanies. Thus, and within reason with regard to length, our improved apparatus parallels short fibers just as well as it parallels long fibers and this is because of the great multiplicity of individual working actions to which each fiber is subjected during its passage through our improved apparatus.

As stated, in actual practice our invention has proven to be satisfactory. We have run sliver through out improved apparatus consisting of cotton which stapled out at from 1 3/32 inch to 15/16ths. Due to the increase in the lustre of the sliver delivered from our improved apparatus over what the same would have been had it been processed through an ordinary drafting system, we find that we achieve considerably greater parallelization of the fibers, a considerable decrease of the bunching of fibers in the finished product, and generally a cleaner product. The foregoing improvement brought about by our improved apparatus gives the promise that in textile mills one may eliminate completely combers as presently used.

Reverting again to roll 10, we preferably forwardly rake teeth of the wire covering the same from about zero degrees to about 7 degrees, considering the direction of rotation of roll 10.

In view of the foregoing it will be seen that we have devised an improved apparatus for treating fibers and at the same time has the various advantages heretofore pointed out.

While we have shown our invention in but one form, it will be obvious to those skilled in the art that it is not so limited but is susceptible of various changes and modifications without departing from the spirit thereof.

What we claim is:

1. In a system for paralleling and blending strands of fibers in the form of sliver, which strands contain fibers of different lengths and without appreciable loss of the shortest fibers, (a) a work roll about 3 5/16 inches in diameter covered with metallic wire having about 400 teeth per square inch, the teeth of which are forwardly raked, (b) a stationary arcuate section of metallic wire having about 400 teeth per square inch and with the points thereof in close running clearance to the points of the wire on said work roll, said arcuate section extending around a portion of the lower periphery of the work roll, (c) the teeth of the wire on the arcuate section being oppositely raked relative to the rake of the teeth on the work roll, (d) a pair of cooperating sliver feed rolls whose diameters are less than the diameter of the work roll mounted close to the work roll and designed to deliver sliver to the work roll ahead of the arcuate section, (e) a pair of cooperating outfeed rolls whose diameters are less than the diameter of the work roll mounted close to the work roll downstream of the arcuate section, (f) means to rotate the work roll at a surface speed faster than the rate of delivery of the sliver by said infeed rolls thereby to draft the sliver prior to entering between arcuate section and the work roll, and (g) means to rotate the outfeed rolls at a surface speed greater than the surface speed of the work roll thereby to assure that no negative draft is applied to the sliver while it is being removed from the work roll.

* * * * *